US005649280A

United States Patent [19]

Blankenship et al.

[11] Patent Number: 5,649,280

[45] Date of Patent: Jul. 15, 1997

[54] METHOD FOR CONTROLLING GRAIN SIZE IN NI-BASE SUPERALLOYS

[75] Inventors: Charles Philip Blankenship; Michael Francis Henry, both of Niskayuna, N.Y.; Eric Scott Huron, Westchester, Ohio; John Michael Hyzak, Shrewsbury, Mass.

[73] Assignee: General Electric Company, Schenectady, N.Y.

[21] Appl. No.: 581,783

[22] Filed: Jan. 2, 1996

[51] Int. Cl.[6] ..... B22F 3/24; C22C 1/04

[52] U.S. Cl. ..... 419/25; 419/29; 419/41; 419/54; 419/55

[58] Field of Search ..... 419/25, 29, 41, 419/54, 55

[56] References Cited

U.S. PATENT DOCUMENTS

| | | | |
|---|---|---|---|
| 3,775,101 | 11/1973 | Freche et al. | 75/213 |
| 3,776,704 | 12/1973 | Benjamin | 29/182.5 |
| 3,793,010 | 2/1974 | Lemkey et al. | 75/170 |
| 3,802,938 | 4/1974 | Collins et al. | 148/126 |
| 3,844,847 | 10/1974 | Bomford et al. | 148/11.5 F |
| 4,957,567 | 9/1990 | Krueger et al. | 148/12.7 |
| 5,393,483 | 2/1995 | Chang | 419/10 |
| 5,413,752 | 5/1995 | Kissinger et al. | 419/28 |

FOREIGN PATENT DOCUMENTS

| | | |
|---|---|---|
| 9218659 | 10/1992 | European Pat. Off. . |
| 9413849 | 6/1994 | European Pat. Off. . |

OTHER PUBLICATIONS

Duk N. Yoon et al. "Method for Minimizing Nonuniform Nucleation and Supersolvus Grain Growth In A Nickel–Base Superalloy". Ser. No. 08/323,969, filed Oct. 17, 1994. (13DV–11903.).

*Primary Examiner*—Charles T. Jordan
*Assistant Examiner*—Daniel Jenkins
*Attorney, Agent, or Firm*—Noreen C. Johnson; William H. Pittman

[57] ABSTRACT

A method of high retained strain forging is described for Ni-base superalloys, particularly those which comprise a mixture of γ and γ' phases, and most particularly those which contain at least about 30 percent by volume of γ'. The method utilizes an extended subsolvus anneal to recrystallize essentially all of the superalloy and form a uniform, free grain size. Such alloys may also be given a supersolvus anneal to coarsen the grain size and redistribute the γ'. The method permits the manufacture of forged articles having a fine grain size in the range of about ASTM 5–12 (5–60 μm).

20 Claims, 12 Drawing Sheets

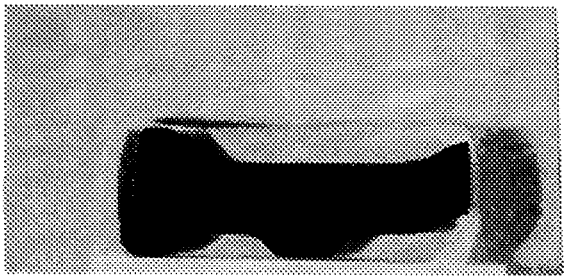
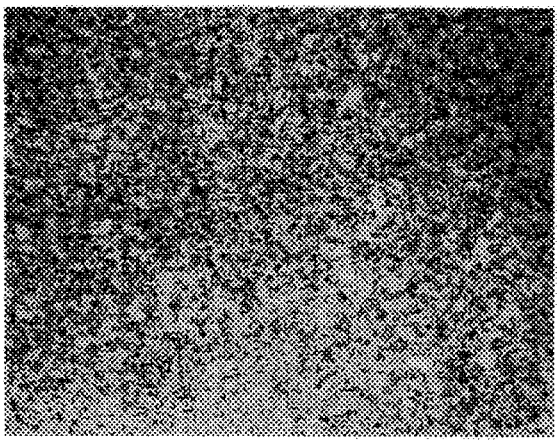
500 μm
FIG. 6A
FIG. 6B

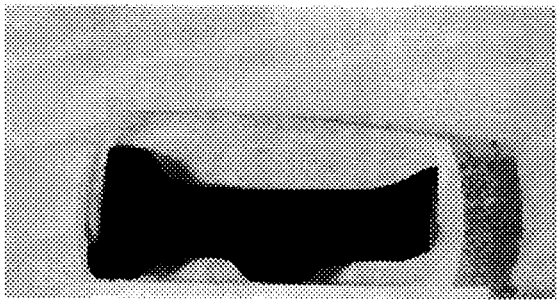
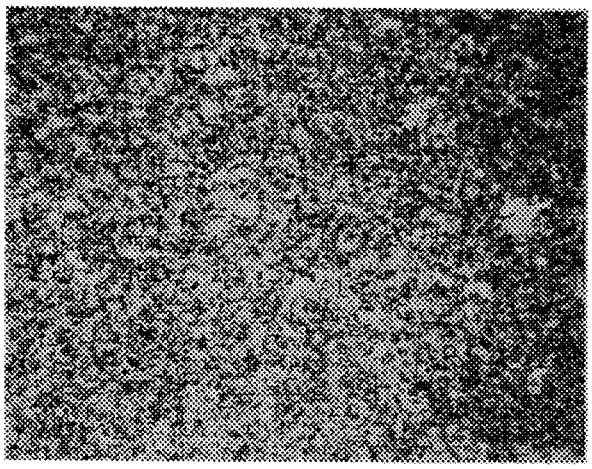
500 μm
FIG. 7A
FIG. 7B

500 μm

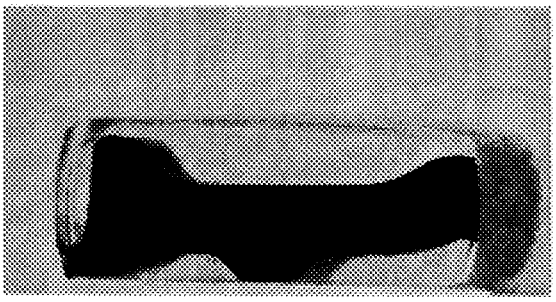
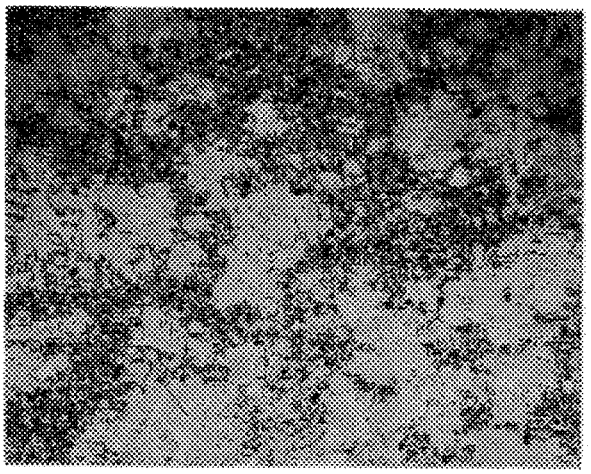
500μm
FIG. 9A
FIG. 9B

METHOD FOR CONTROLLING GRAIN SIZE IN NI-BASE SUPERALLOYS

FIELD OF THE INVENTION

This invention is generally directed to a method of working a Ni-base superalloy articles, such as by forging, to impart retained strain into the articles and provide a basis for subsequent recrystallization and the creation and of a microstructures with a substantially uniform, average grain sizes in the range of about 5–60 microns. Specifically, the method comprises working a fine grain γ' Ni-base superalloy preform to form a worked article at a subsolvus temperature and relatively rapid strain rate to impart a level of retained strain that is above a critical level of retained strain for the superalloy of interest, followed by extended subsolvus annealing of the forged article, in order to completely recrystallize the worked article and produce a microstructure with a uniform, average grain size of about 5–10 μm. In a preferred embodiment, subsolvus annealing is followed by supersolvus annealing to coarsen the average grain size to about 10–60 μm. Controlled cooling may also be employed to control the distribution of γ' after the desired grain size has been achieved.

BACKGROUND OF THE INVENTION

The performance requirements for gas turbine engines are continually being increased to improve engine efficiency, necessitating higher internal operating temperatures. Thus, the maximum operating temperatures of the materials used for components in these engines, particularly turbine rotor components such as turbine disks, continue to rise. Components formed from powder metal (P/M), precipitation strengthened γ' Ni-base superalloys can provide a good balance of creep, tensile and fatigue crack growth properties to meet these performance requirements. Typically, P/M γ' Ni-base superalloys are produced by consolidation of superalloy powders, using methods such as extrusion consolidation. These consolidated P/M superalloys are used to make various forging preforms. Such preforms are then isothermally forged into finished or partially finished forms, and finally heat treated above the γ' solvus temperature to control the grain size and γ' distribution. Methods for consolidation of P/M superalloys and the creation of preforms are well known.

With respect to γ' Ni-base superalloys, isothermal forging is a term that is used to describe a well-known forging process that is done at slow strain rates (e.g. typically less than 0.01 $s^{-1}$) and temperatures slightly below the γ' solvus temperature (e.g. <100° F.), but above the recrystallization temperature of the particular superalloy. These processing parameters are chosen mainly to foster superplastic deformation, which in turn results in low forging loads and low die stresses during forging. Isothermal forging requires expensive tooling, an inert environment, and slow ram speeds for successful operation. Superplastic deformation in the workpiece allows large geometric strains to be achieved during the forging operation without causing cracking within the forging. At the end of an isothermal forging operation, no substantial increase in dislocation density should be observed, as swain is accommodated by grain boundary sliding and diffusional processes. In the event that dislocations are generated, the high temperatures and slow stroke rates allow dynamic recovery to occur. Thus, this forging method is intended to minimize retained metallurgicai strain at the conclusion of the forming operations. Isothermal forging is known to produce a uniform, fine average grain size, typically on the order of ASTM 12–14 (3–5 μm). Reference throughout to ASTM intercept or ALA grain sizes is in accordance with methods E112 and E930 developed by the American Society for Testing and Materials, rounded to the nearest whole number. For applications that demand enhanced creep and time dependent fatigue crack propagation resistance, coarser grain sizes of about ASTM 6–8 (20–40 μm) are required. These coarser grain sizes are currently achieved in isothermally forged superalloys by heat treating above the γ' solvus, but below the incipient melting temperature of the alloy. After isothermal forging and supersolvus heat treatment, cooling and aging operations are also frequently utilized to control the γ' distribution. However, isothermal forging does have some limitations with respect to controlling the grain size of the forged articles.

While isothermal forging tends to produce a ASTM 12–14 (3–5 μm) average grain size, subsequent supersolvus annealing causes the average grain size to increase in a relatively step-wise fashion to about ASTM 6–8 (20–40 μm). Thus, it is generally not possible to control the average grain size over the entire range of sizes between about ASTM 6–14 (3–40 μm) using a single forging method, which control may be very desirable to achieve particular combinations of alloy properties, particularly mechanical properties. Isothermal forging processes are relatively slow forming processes compared to other well-known forging processes, such as hot die or hammer forging processes, due to the slow strain rates employed. Isothermal forging typically requires more complex forging equipment due to the need to accurately control slow strain rate forging. It also requires the use of an inert forging environment, and it is also know to be difficult to maintain thermal stability in many isothermal forges. Therefore, components formed by isothermal forging are generally more costly than those formed by other forging methods.

In addition, unless isothermal forging processes are very carefully controlled, it is possible to impart retained strain into the forged articles, which can in turn result in critical grain growth during subsequent heat treatment operations. Complex contoured forgings contain a range of localized strains and strain rates. If forging temperatures are too low, or local strain rates are too high, diffusional processes that prevent strain energy from being stored in the microstructure cannot keep up with the imposed strain rate. In such cases, dislocations are generated causing strain energy to be retained within the microstructure. As used herein, the term "retained strain" refers to the dislocation density, or metallurgical strain present in the microstructure of a particular alloy. When working a superalloy at temperatures that are less than the alloy recrystallization temperature, the amount of retained strain is directly related to the amount of geometric strain because diffusional recovery processes in the alloy microstructure occur very slowly at these temperatures. However, the amount of retained strain that occurs in a superalloy microstructure that is worked at temperatures that are above the recrystallization temperature is more directly related to the temperature and strain rate at which the deformation is done than the amount of geometric strain. Higher working temperatures and slower strain rates result in lower amounts of retained strain.

When Ni-base superalloys that contain retained strain are subsequently heat treated above the γ' solvus, critical grain growth (CGG) may occur, wherein the retained strain energy in the article is sufficient to cause limited nucleation and substantial growth (in regions containing the retained strain) of very large grains, resulting in a bimodal grain size distribution. Critical grain growth is defined as localized abnormal excessive grain growth to grain diameters exceeding the desired range, which is generally up to about ASTM 2 (180 μm) for articles formed from consolidated powder metal alloys. Critical grain growth can cause the formation of grain sizes between about 300–3000 μm. Factors in addition to dislocation density and retained strain, such as the carbon, boron and nitrogen content, and subsolvus annealing time, also appear to influence the grain size distribution when critical grain growth occurs. Critical grain growth may detrimentally affect mechanical properties such as tensile strength and fatigue resistance.

The affect of retained strain on the final grain size in forged Ni-base superalloys has been described, for example, in U.S. Pat. No. 4,957,567, which is herein incorporated by reference. Applicants have also obtained data from tests described herein that measure grain size as a function of room temperature compressive strain following supersolvus annealing, as shown in FIG. 1. FIG. 1 summarizes the CGG characteristics for the P/M γ' Ni-base superalloy Rene' 88DT. Analogous behavior has been observed in Rene' 95, and is known to occur in cast and wrought superalloys and other alloy systems. This CGG behavior after room temperature deformation may be translated to predict CGG behavior due to elevated temperature deformation; however, strain rate and temperature then replace strain as the primary variables that influence the amount of retained strain. Generally, for P/M γ' superalloys, there is a range of slow strain rates and corresponding forging temperatures in which critical grain growth can be avoided, thus producing a microstructure of uniform grains having an average grain size of ASTM 6–8 (20–40 μm) after supersolvus heat treatment. This range is roughly 0.01 $s^{-1}$ or slower, at forging temperatures that are 0°–200° F. below the solvus temperature. It would be desirable to forge well below 0.01 $s^{-1}$ in order to avoid the potential for CGG but this is not practical from a productivity standpoint.

Critical grain growth is thought to result from nucleation limited recrystallization followed by grain growth until the strain free grains impinge on one another. The resulting microstructure has the bimodal distribution of grain sizes noted above. As illustrated in FIG. 1, CGG occurs over a relatively narrow range of retained strain. Slightly higher retained strain results in a higher nucleation density and a finer and more homogeneous resultant grain size. Slightly lower retained strain is insufficient to trigger the recrystallization process. Thus, the term critical grain growth was adopted to describe the observation that a critical amount or range of retained swain was required to lead to this undesirable microstructure.

Critical grain growth is not observed in Ni-base superalloys containing a high volume fraction of γ' until heat treatment is performed above the γ' solvus. It is therefore noted that, in this complicated alloy system, factors in addition to retained strain influence grain structure evolution. Particles that pin grain boundaries play an active role in controlling grain size, most notably, the coherent, high volume fraction γ' phase. Carbides, borides and oxides are also reported to influence final grain size, especially if the alloy is heat treated above the γ' solvus.

An alternative procedure to high temperature-low strain rate, isothermal forging is to forge Ni-base superalloy components at higher strain rates and lower temperatures, such that the retained strain everywhere is greater than the critical amount, and above the range that would lead to critical grain growth. This approach is also described, for example, in U.S. Pat. No. 5,413,572, which is incorporated herein by reference. The method described involves forging to achieve high retained strain, followed by supersolvus annealing to recrystallize the microstructure. The grain sizes obtained were described as being in the range of about ASTM 2–9 (15–180 μm) for article formed from P/M forging preforms.

However, it is desirable to develop additional forging methods for these Ni-base superalloys, particularly methods that permit more control over the grain size of the microstructure in the range of ASTM 5–14 (3–60 μm) than present forging methods, and specifically methods that provide control over a broader range of these grain sizes, so as to facilitate the production of forgings having a fine, uniform grain size, while also avoiding CGG.

SUMMARY OF THE INVENTION

This invention comprises forging fine-grained Ni-base superalloy preforms, such as consolidated P/M preforms, so as to impart retained strain energy into the alloy microstructure, followed by extended subsolvus annealing of the forged article at a temperature which is above the recrystallization temperature, but below the γ' solvus temperature, in order to completely recrystallize the worked article and produce a uniform, fine grain size microstructure. The retained strain energy imparted must be sufficient to cause essentially complete recrystallization and the development of a uniform recrystallized grain size. The extended subsolvus annealing is preferably also followed by supersolvus annealing to coarsen the grain size and redistribute the γ'. After either the subsolvus annealing or supersolvus annealing steps, controlled cooling of the article to a temperature below γ' solvus temperature may be employed to control the distribution of the γ'. The method may be used to control the average grain size of an article forged according to the method within a range of about ASTM 5–12 (5–60 μm), as well as controlling the distribution of γ' within the alloy microstructure.

The method produces forgings having a fine, uniform grain size over a broader range than has been achievable with either low strain rate isothermal forging methods or high retained strain forging methods that utilize only supersolvus annealing.

The method may be briefly and generally described as the steps of: providing a Ni-base superalloy having a recrystallization temperature, a γ' solvus temperature and a microstructure comprising a mixture of γ and γ' phases, wherein the γ' phase occupies at least 30% by volume of the Ni-base superalloy; working the superalloy at preselected working conditions, comprising a working temperature less than the γ' solvus temperature and a strain rate greater than a predetermined strain rate, $\dot{\epsilon}_{min}$ sufficiently to store a predetermined minimum amount of retained strain, $\epsilon_{min}$, per unit of volume throughout the superalloy, to form an article, wherein $\epsilon_{min}$ is sufficient to promote subsequent recrystallization of a uniform grain size microstructure throughout the article; subsolvus annealing the article at a subsolvus temperature for a time sufficient to cause recrystallization of a uniform grain size throughout the article; and cooling the article from the subsolvus annealing temperature at a predetermined rate in order to cause the precipitation of γ'.

BRIEF DESCRIPTION OF THE DRAWINGS

FIGS. 6A, 6B, 7A, 7B, 8A, 8B, 9A and 9B illustrate varying degrees of critical grain growth observed in the subscale forging specimens.

DETAILED DESCRIPTION OF THE INVENTION

Figure 1:
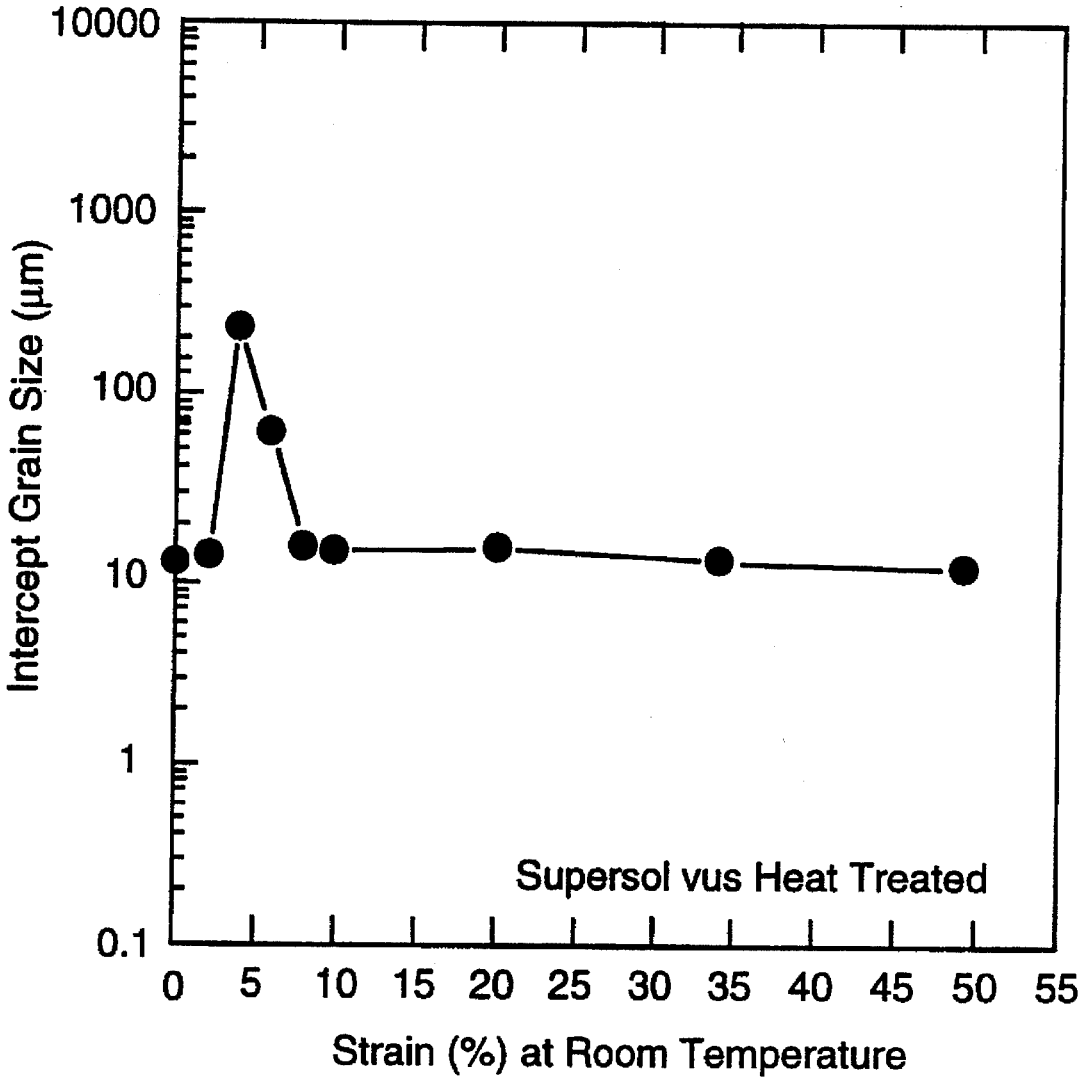
FIG. 1 is a plot of grain size after supersolvus heat treatment as a function of room temperature compression (retained strain).

Applicants have invented a method of forging precipitation strengthened γ' Ni-base superalloys which may be utilized to produce forged articles having a substantially-uniform, fine grain size over the range of about ASTM 5–12 (5–60 μm). The method employs high strain rate, or high strain, subsolvus forging to impart at least a minimum level of retained strain energy per unit of volume throughout the article during the forging operation. This amount of retained strain energy is sufficient to recrystallize the microstructure and forms uniform, fine grain size during an extended subsolvus anneal. The method also may incorporate subsequent supersolvus annealing, controlled cooling, or both, to further control the grain size or the distribution of γ'.

The process begins with the step of providing a Ni-base superalloy containing a relatively large volume fraction of γ', usually in the form of a P/M forging preform. A forging preform may be of any desired size or shape, such as those illustrated in the FIGS. herein, that serves as a suitable preform, so long as it possesses characteristics that are compatible with being formed into a forged article, as described further below. The preform may be formed by any number of well-known techniques, however, the finished forging preform should have a relatively fine grain size within the range of about 1–50 μm. In a preferred embodiment, a forging preform is provided by hot-extrusion of a precipitation strengthened γ' Ni-base superalloy powder using well-known methods, such as by extruding the powder at a temperature sufficient to consolidate the particular alloy powder into a billet, blank die compacting the billet into a desired shape and size, and then hot-extruding to form the forging preform. Preforms formed by hot-extrusion typically have an average grain size on the order of ASTM 12–16 (1–5 μm). Another method for forming preforms may comprise the use of spray-forming, since articles formed in this manner also characteristically have a grain size on the order of about ASTM 5.3–8 (20–50 μm). The provision of forging preforms in the shapes and sizes necessary for forging into finished or semifinished articles is well known, and described briefly herein. However, the method of the present invention does not require that the Ni-base superalloy be provided as a forging preform. It is sufficient as a first step of the method of the present invention to merely provide a Ni-base superalloy preform having the characteristics described above that is adapted to receive some form of a working operation sufficient to introduce the necessary retained swain. Also, the forging preform may comprise an article that has been previously worked, such as by isothermal forging, or other forming or forging methods.

Applicants believe that the method of this invention may be applied generally to Ni-base superalloys comprising a mixture of γ and γ' phases. However, references such as U.S. Pat. No. 4,957,567 suggest that the minimum content of γ' should be about 30 percent by volume at ambient temperature. Such Ni-base superalloys are well-known. Representative examples of these alloys, including compositional and mechanical property data, may be found in references such as Metals Handbook (Tenth Edition), Volume 1 Properties and Selection: Irons, Steels and High-Performance Alloys, ASM International (1990), pp. 950–1006. The method of the present invention is particularly applicable and preferred for use with Ni-base superalloys that have a microstructure comprising a mixture of both γ and γ' phases where the amount of the γ' phase present at ambient temperature is about 40 percent or more by volume. These γ/γ' alloys typically have a microstructure comprising 7 phase grains, with a distribution of γ' particles both within the grains and at the grain boundaries, where some of the particles typically form a serrated morphology that extends into the γ grains. The distribution of the γ' phase depending largely on the thermal processing of the alloy. Table 1 illustrates a representative group of Ni-base superalloys for which the method of the present invention may be used and their compositions in weight percent. These alloys may be described very generally as alloys having compositions in the range 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent, excepting incidental impurities. However, Applicants believe that other alloy compositions comprising the mixture of γ and γ' phases described above are also possible. Applicants further believe that this may include Ni-base superalloys that also include small amounts of other phases, such as the δ or Laves phase. A Ni-base superalloy of the present invention is also described in U.S. Pat. No. 4,957,567. This alloy has a composition in the range of 12–14 Co, 15–17 Cr, 3.5–4.5 Mo, 3.5–4.5 W, 1.5–2.5 Al, 3.2–4.2 Ti, 0.5–1.0 Nb, 0.01–0.06 Zr, 0.01–0.06 C, 0.01–0.04 B, up to 0.01 V, up to 0.3 Hf, up to 0.01 Y, and a balance of Ni excepting incidental impurities, in weight percent, which also comprehends the composition of Rene'88 as set forth herein. The Ni-base superalloys described herein have a recrystallization temperature; a γ' solvus temperature and an incipient melting temperature. The recrystallization temperature for the alloys range roughly from 1900° to 2000° F., depending on the nature and concentrations of the varying alloy constituents. The γ' solvus temperatures for these alloys typically range from about 1900° to 2100° F. The incipient melting temperatures of these alloys are typically less than about 200° F. above their γ' solvus temperatures.

TABLE 1

| Element | Alloy | | | | | |
|---|---|---|---|---|---|---|
| | Rene'88 | Rene'95 | IN-100 | U720 | Waspaloy | Astroloy |
| Co | 13 | 8 | 15 | 14.7 | 13.5 | 15 |
| Cr | 16 | 14 | 10 | 18 | 19.5 | 15 |
| Mo | 4 | 3.5 | 3 | 3 | 4.3 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |
| Zr | 0.05 | 0.05 | 0.06 | 0.03 | 0.07 | 0 |
| C | 0.05 | 0.07 | 0.18 | 0.04 | 0.07 | 0.06 |
| B | 0.015 | 0.01 | 0.014 | 0.03 | 0.006 | 0.03 |
| Ni | bal. | bal. | bal. | bal. | bal. | bal. |

After providing the Ni-base superalloy, the next step in the method is the step of working the superalloy at preselected working conditions to form the desired article, preferably by forging a preform into a forged article. The preselected working conditions comprise a working temperature less than the γ' solvus temperature, a strain rate greater than a predetermined strain rate, $\dot{\epsilon}_{min}$, that are sufficient to store a predetermined minimum mount strain energy or retained strain, $\epsilon_{min}$, per unit of volume throughout the superalloy. The worked article should contain 8min sufficient to promote subsequent recrystallization of a uniform grain size microstructure throughout the article under appropriate annealing conditions. Reference herein to a "uniform grain size" is intended to describe a microstructure that is not bimodal, and that does not have an ALA grain size that is indicative of CGG (i.e.≧ASTM 0). In the case of forging, forging is done at a subsolvus temperature with respect to the Ni-base superalloy provided. The subsolvus forging temperature preferably will be in a range ≦600° F. below the γ' solvus of the superalloy, depending on the strain rate employed. This range of temperatures roughly describes those temperatures that are at or above the recrystallization temperature. However, lower forging temperatures, including ambient temperatures, may also be employed. The predetermined strain rates, $\dot{\epsilon}_{min}$, used for working the superalloy at temperatures ≦600° F. below the γ' solvus will be higher than strain rates currently used to form these superalloys, in the range of about 0.01 $s^{-1}$ or greater. High strain rates are employed in order to impart sufficient retained strain energy as described above, and overcome the effects of dynamic recovery and/or recrystallization that would naturally tend to occur at the higher subsolvus forging temperatures described herein, such that controlled recrystallization may be employed to exert more exacting grain size control. At the lower end of this temperature range, the strain rate must be selected so as to not create excessive die stresses or cause the fracture of the preform. At temperatures near the γ' solvus, the strain rate must be high enough to achieve the minimum amount of retained strain, $\epsilon_{min}$, as described further below, despite the fact that significant dynamic recovery and/or recrystallization may occur during forging. When forging at temperatures below this range, $\dot{\epsilon}_{min}$ must also be selected to avoid excessive stresses in the die or the forging preform, and strain rates slower than 0.01 $s^{-1}$ may be required. Forging may be performed using ordinary means for forging Ni-base superalloys, such as hot die forging. In the case of forging, the steps recited thus far generally comprise: heating a forging preform to the forging temperature, forging the preform within the temperature and swain rate conditions described above, and cooling of the forged article, generally to ambient temperature.

As described, Applicants have determined that in order to obtain the recrystallization of substantially all of the microstructure of the forged article and form a substantially uniform, fine grain size in the ranges described herein, that it is necessary to impart $\epsilon_{min}$ into the forged article. This retained strain energy serves as the driving force for nucleation of recrystallized grains. Therefore, this $\epsilon_{min}$ should be distributed throughout the microstructure, such that the minimum retained strain should be on a per unit of volume basis. The retained strain energy must achieve a minimum level throughout the article in order to avoid the problem of critical grain growth which is caused by having regions within an article with levels of retained swain below the threshold, such that grain growth is initiated, but not bounded by other adjacent nucleating grains. While it is difficult to measure the absolute threshold of retained strain energy necessary, $\epsilon_{min}$ must be maintained so as to provide sufficient nucleation sites for subsequent recrystallization at the subsolvus annealing conditions described further below, of a uniform average intercept grain size of about ASTM 10 (10 μm) or less, preferably in a range between about ASTM 10–12 (5–10 μm), without an ALA grain size that is indicative of critical grain growth (e.g. ≧ASTM 0 (300 μm). This $\epsilon_{min}$ will depend for each superalloy on the chemical composition of the superalloy, the morphology, including the grain size, of the microstructure of the forging preform as well as other factors. Applicants have measured the retained strain energy or strain as represented by the percentage of room temperature reduction in height, as a function of the recrystallized grain size for Rene'88, as shown in FIG. 1. In this test, regularly shaped Rene'88 specimens were compressed at room temperature to produce varying degrees of reduction in height (i.e. varying levels of retained strain energy, since almost all of the strain energy is stored in the compressed articles at room temperature). After supersolvus annealing, the grain size was measured for each of the specimens. The results indicate that $\epsilon_{min}$ as measured using this method was about 6% reduction in height. Between about 1–6% reduction in height, critical grain growth was observed, producing grains up to about ASTM 0 (300 μm). Similar results have been observed for the Ni-base superalloy Rene'95, and are expected for other Ni-base superalloys. Similar results are also described in U.S. Pat. No. 5,413,572.

After working the superalloy, it is necessary to utilize an additional step of extended subsolvus annealing in order to promote recrystallization and produce the desired fine grain microstructure. In a preferred embodiment, the subsolvus annealing is done at a temperature above the recrystallization temperature, which is generally recognized as being between about 1900°–2000° F. for high γ' content alloys, but below the γ' solvus temperature. Preferably, the subsolvus annealing will be done at a temperature ≦100° F. below the γ' solvus. Means for subsolvus annealing are well-known. The subsolvus annealing time will depend on the thermal mass of the forged article. The annealing time must be sufficient to recrystallize substantially all of the alloy microstructure in order to form the uniform, fine grain size and avoid CGG. Typically, a sufficient annealing time will range between about 4–168 hours. Applicants have observed an average grain size after subsolvus annealing in several superalloys of the types described herein, in the ranges of approximately ASTM 10–12 (5–10 μm). The grain size following subsolvus annealing will depend on many factors, including the grain size of the forging preform, the amount of retained swain, the subsolvus annealing temperature and the composition of the superalloy, particularly the presence of grain boundary pinning phases, such as carbides and carbonitrides. While it is generally preferred to perform additional annealing and aging steps after subsolvus annealing to further develop the grain size, forged articles may be utilized following the extended subsolvus anneal.

If a grain size of ASTM 10–12 is the desired grain size, the forged article may be cooled following the subsolvus anneal to ambient temperatures, resulting in the precipitation of γ'. For annealing temperatures that are very near the γ' solvus, some degree of control may be exercised over the distribution of the γ' following subsolvus annealing. Applicants have determined that for cooling from supersolvus temperatures, the cooling rate should be in the range of 100°–600° F./minute so as to produce both fine γ' particles within the γ grains and γ' within the grain boundaries, as described herein. Cooling at these cooling rates may also make it possible to exercise similar control over the precipitation of γ' where the subsolvus annealing temperature is very close to the γ' solvus, such that a significant portion of the γ' is in solution during the anneal, except that the microstructure will contain some undissolved primary γ'.

In a preferred embodiment, following the step of subsolvus annealing, an additional step of supersolvus annealing is employed for a time sufficient to solutionize at least a portion, and preferably substantially all, of the γ' and cause some coarsening of the recrystallized grain size to about ASTM 5–10 (10–60 μm). For example, sections of articles forged at temperatures between 1600°–1800° F. and strain rates of 0.01–0.1 $s^{-1}$, as described herein, had an average grain size in the range of ASTM 8–9.5 (11–18 μm) after an 8 hr. subsolvus anneal at 1925° F. followed by a supersolvus ramp and hold for 1 hr. at 2100° F. Larger grain sizes up to ASTM 5 (60 μm), and perhaps larger, may be achieved for longer annealing times. The temperature of the anneal is preferably up to about 100° F. above the γ' solvus temperature, but in any case below the incipient melting temperature of the superalloy The forged article is typically annealed in the range of about 15 minutes to 5 hours, depending on the thermal mass of the forged article and the time required to ensure that substantially all of the article has been raised to a supersolvus temperature, but longer annealing times are possible. In addition to preparing the forged article for subsequent cooling to control the γ' phase distribution, this anneal is also believed to contribute to the stabilization of the grain size of the forged article. Both subsolvus annealing and supersolvus annealing may be done using known means for annealing Ni-base superalloys.

After supersolvus annealing, the cooling rate of the article may be controlled until the temperature of the entire article is less than the γ' solvus in order to control the distribution of the γ' phase throughout the article. Applicants have determined that in a preferred embodiment, the cooling rate after supersolvus annealing should be in the range of 100°–600° F./minute so as to produce both fine γ' particles within the γ grains and γ' within the grain boundaries. Typically the cooling is controlled until the temperature of the forged article is about 200°–500° F. less than the solvus temperature, in order to control the distribution of the γ' phase in the manner described above. Faster cooling rates (e.g. 600° F./minute) tend to produce a fine distribution of particles within the γ grains. Slower cooling rates (e.g. 100° F./minute) tend to produce fewer and coarser γ' particles within the grains, and a greater amount of γ' along the grain boundaries. Various means for performing such controlled cooling are known, such as the use of oil quenching or air jets directed at the locations where cooling control is desired.

It is noted that articles formed using the method of this invention may also be aged sufficiently, using known techniques, to further stabilize the microstructure and promote the development of desirable tensile, creep, stress rupture, low cycle fatigue and fatigue crack growth properties. Means for performing such aging and aging conditions are known to those skilled in the art of forging Ni-base superalloys.

It is also noted that between the steps of working and subsolvus annealing, and subsolvus annealing and supersolvus annealing that the article may be cooled, such as to room temperature, without departing from the method described herein. It is common in forging practice to perform each of these steps discreetly, rather than in a continuous fashion, such that articles will frequently be cooled to room temperature and be reheated therefrom to perform the next process step.

EXAMPLE 1

The objectives of the work described in this example were to determine the fundamental metallurgical characteristics of high retained strain forging, including forging and both supersolvus annealing and extended subsolvus annealing plus supersolvus annealing (in accordance with the method of this invention), using laboratory experiments, and by application of the process on a subscale hot die forging press.

The superalloy used for the work described in the example was Rene'88, having the nominal composition described herein. The Rene'88DT extrusions were obtained from Special Metals Company and Wyman Gordon, Inc. for this study. Special Metals extrusion 3989 was used for the laboratory investigation, and Wyman Gordon extrusions E499 and E756 were used for the subscale demonstration phase. The composition of each extrusion is listed in Table 2.

TABLE 2

Composition of extrusions used in this study (wt %)

| | Co | Cr | Mo | W | Al | Ti | Nb | Zr | C | B | $N_2$ (ppm) | $O_2$ (ppm) |
|---|---|---|---|---|---|---|---|---|---|---|---|---|
| 3989 | 13.2 | 16.0 | 3.97 | 4.01 | 2.09 | 3.76 | 0.72 | 0.040 | 0.040 | 0.017 | 2 | 140 |
| E499 | 12.9 | 16.0 | 3.98 | 3.99 | 2.20 | 3.79 | 0.70 | 0.045 | 0.048 | 0.014 | 29 | 132 |
| E756 | 12.9 | 15.9 | 4.02 | 3.97 | 2.12 | 3.70 | 0.68 | 0.043 | 0.049 | 0.014 | 16 | 123 |

The laboratory investigation utilized right circular cylinders (0.4 inches in diameter and 0.6 inches long) and double cone specimens (having a cylindrical section that was 1.0 inches in diameter and 0.333 inches long, two equal, opposing, truncated conical sections that tapered from a diameter of 0.333 inches to the diameter of the cylindrical section, and an overall length of 0.833 inches) that were machined from P/M extruded Rene' 88DT (extrusion 3989). The extruded microstructure was characterized by recrystallized grains measuring 1–5 μm in diameter, having 0.1–1 μm primary γ' particles. Unrecrystallized powder particles measuring 30–50 μm in diameter were observed throughout the billet cross section. The apparent area fraction of these unrecrystallized regions varies throughout the cross section, but was on the order of 0.1.

The laboratory forging was performed on a servohydraulic machine in a clamshell furnace. Two procedures were followed for compression testing. For the cylinders, the SiC pushrods were heated to the forging temperatures described herein, then the testing component (cylinder+hardened glass lubricant+SiN platens) was placed on the lower push rod and a 100 lb load applied. After the cylinder was at the forging temperature for ten minutes, the test was run. Due to extremely high loads, the procedure was modified for the double cone specimens. The SiC push rods were only heated to 1000° F. to minimize the temperature difference between the testing component and the push rods (thermal shock was thought to have caused several failures of the push rods during double cone tests). The entire apparatus was then brought to temperature and after a ten minute soak, the test was run.

Tests were run at constant true strain rates of 0.1, 0.03 and 0.01 $s^{-1}$. After 50% nominal reduction in height, the samples were unloaded, removed from the furnace and air cooled.

Transmission electron microscopy (TEM) was performed on sections of cylinders in the "as-compressed" condition. Slices were made parallel to the forging direction, and mechanically ground to 100 μm in thickness. Three millimeter disks were punched out, and electropolished in an 80% methanol 20% perchloric acid solution. The microstructure was characterized using a Philips EM430 operated at 300 kV.

After a γ' supersolvus heat treatment of 2100° F. for 2 hours, metallographic sections were mechanically polished and etched with Walker's reagent. Average grain size was measured according to ASTM method E112, except on samples where a bimodal distribution of grain sizes was encountered. In those cases, the abnormally large grains were avoided in measuring an average, or background grain size, and the large grains were measured individually leading to an "as large as" (ALA) grain size using ASTM method E930.

Figure 2A:
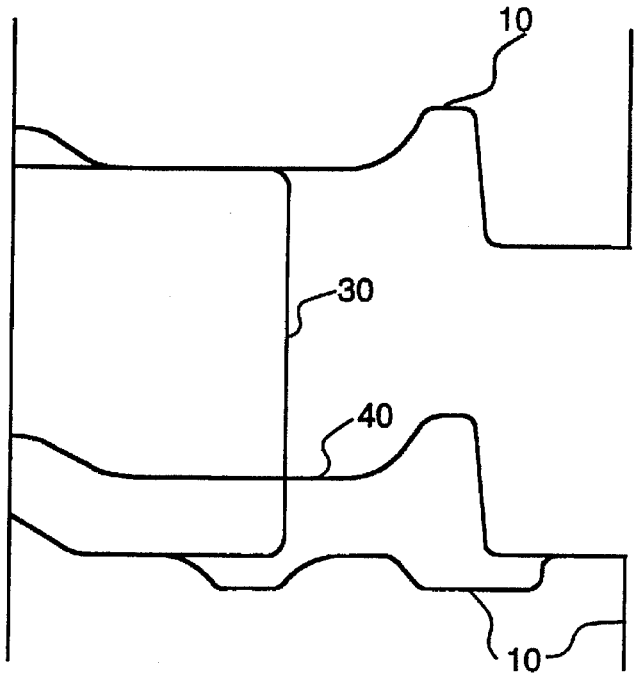
FIGS. 2A and 2B illustrate the resulting geometry after forging the 3.5 inch and 4.4 inch diameter billets, respectively.
Figure 2B:
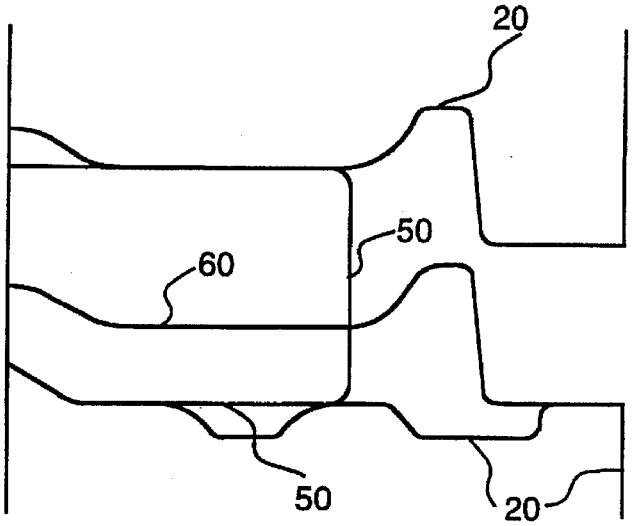

The subscale forging trials were performed using a 1500 ton, hot die press. Referring to FIGS. 2A and 2B, IN718 die sets (10 and 20, respectively) were configured to provide shapes that would apply sufficient strain to test the procedure. Die temperature was not an intentional variable, though it varied slightly from run to run. The nominal die temperature was held near 1100° F. The press velocity was 30 inches/rain for each test. Mull temperatures chosen based on the laboratory double cone specimen results were: 1600°, 1700°, 1800°, 1900° F. Initial mult geometries are given in Table 4 and shown in FIGS. 2A and 2B. The nearly cylindrical mult 30 of FIG. 2A had a volume of 22.97 in.$^3$ and a weight of 6.91 lbs, and produced forged disk 40. The nearly cylindrical mult 50 of FIG. 2B had a volume of 22.49 in.$^3$, and a weight of 6.77 lbs, and produced forged disk 60.

TABLE 3

Initial mult geometries for subscale forging experiments

| Extrusion | Diameter | Initial Height | Nominal True Strain after Upset | Nominal Strain Rate |
|---|---|---|---|---|
| E499 | 4.4" | 1.5" | 0.7 | 0.3–0.7 $s^{-1}$ |
| E756 | 3.5" | 2.4" | 1.0 | 0.2–0.7 $s^{-1}$ |

The forged disks were sectioned into quarters. One quarter was given a supersolvus anneal by placing it in a 2100° F. furnace for 1 hr. A second quarter was given a subsolvus stabilization anneal at 1925° F. for 15 minutes followed by a two hour ramp to a supersolvus temperature of 2100° F., where it was held for one hour. A third quarter was given an extended subsolvus anneal of 1925° F. for 8 hr. followed by a two hr. ramp to a supersolvus temperature of 2100° F. where it was held for one hour. All sections were air cooled after heat treatment. The results of each of these experiments is summarized below.

Right Circular Cylinders

Table 4 contains the processing conditions and resulting grain sizes after supersolvus heat treatment.

TABLE 4

Grain size after forging and supersolvus heat treatment (RCC's)

| Strain Rate ($s^{-1}$) | Temperature (°F.) | Average Intercept Grain Size μm(ASTM) | As large As Grain Size μm(ASTM) |
|---|---|---|---|
| 0.1 | 1600 | 11(10) | 85(4) |
| 0.1 | 1700 | 11(10) | 55(5) |
| 0.1 | 1800 | 13(9) | 70(4.5) |
| 0.01 | 1500 | 13(9) | 95(3.5) |
| 0.01 | 1600 | 11(10) | 65(.4.5) |
| 0.01 | 1700 | 13(9) | 55(5) |
| 0.01 | 1800 | 12(9.5) | 75(4) |

Figure 3:
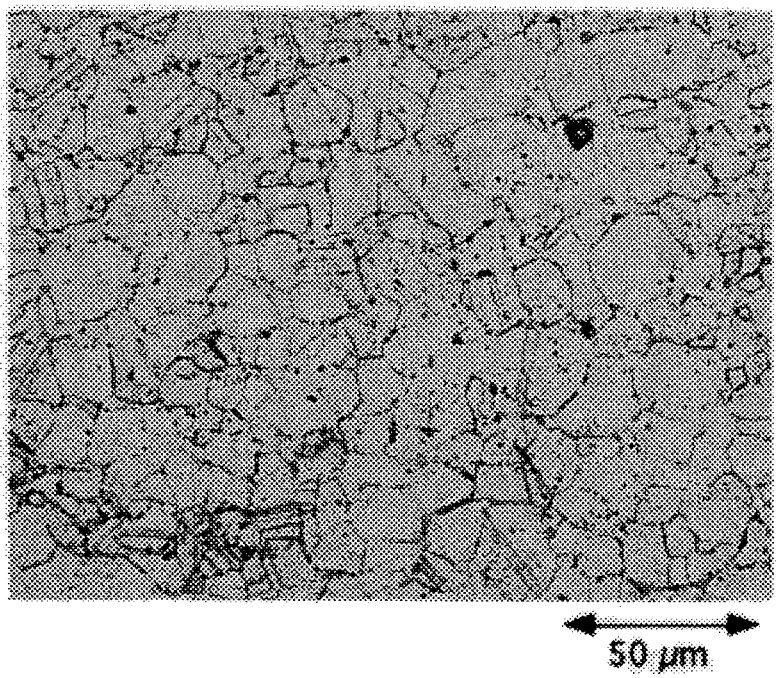
FIG. 3 is an optical photomicrograph showing the grain structure of the cylinder compressed at 1600° F./0.1 $s^{-1}$ and heat treated at 2100° F. for 2 hours.

FIG. 3 illustrates the fine grain microstructure that is produced after supersolvus heat treatment. Lightly decorated prior powder particle boundaries (MC and $ZrO_2$) can be seen, and no primary γ' is observed.

Two conditions were chosen for examination in detail. Previous studies have indicated that 1800° F. might not be cold enough to accumulate enough metallurgicai swain to avoid critical grain growth, therefore, effort was focused on 1600° and 1700° F. compression temperatures. TEM was performed on sections from samples compressed at 1600° F./0.1 $s^{-1}$ and 1700° F./0.01 $s^{-1}$ forging conditions. Both microstructures contain significant amounts of retained metallurgical swain in the form of dislocation tangles, though the dislocation structures appeared more dense in the 1600° F. /0.1 $s^{-1}$ microstructure.

Production heat treatment cycles typically contain a stabilization anneal at 1925° F. on the way to 2100° F. Therefore, TEM samples were prepared from the double cone specimen compressed at 1600° F./0.1 $s^{-1}$ after the stabilization phase of the heat treatment (1925° F. for 0.25 hours) to investigate the state of the microstructure compared to the heavily deformed structure found in the as-compressed condition. There were areas with dense dislocation tangles, and other regions that were essentially strain free. This structure is representative of the recrystallization process. Recovery can be discounted, as this process tends to occur continuously throughout the microstructure, rather than in discrete nucleation and growth events. The 1925° F. heat treatment followed by a ramp to 2100° F. appears to allow the nucleation and (limited) growth of recrystallized grains prior to passing through the $\gamma'$ solvus. This sequence is preferred, as the grain structure can undergo its two major alterations one step at a time. Recrystallization and elimination of statistically stored dislocations can occur in the presence of the efficient pinning phase ($\gamma'$). The fine grain microstructure can then undergo a growth spurt after the dissolution of the major pinning phase without the added complication of another strong driving force (retained strain).

Figure 4:
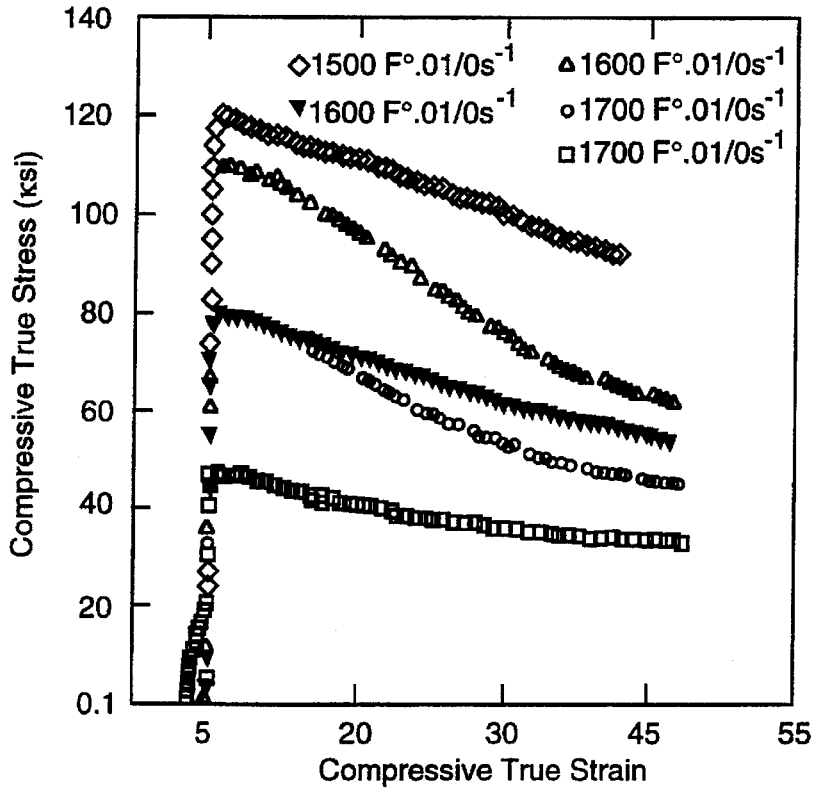
FIG. 4 is a plot of flow stress data as a function of strain rate for low temperature-high strain rate compression of Rene' 88DT.
Figure 5:
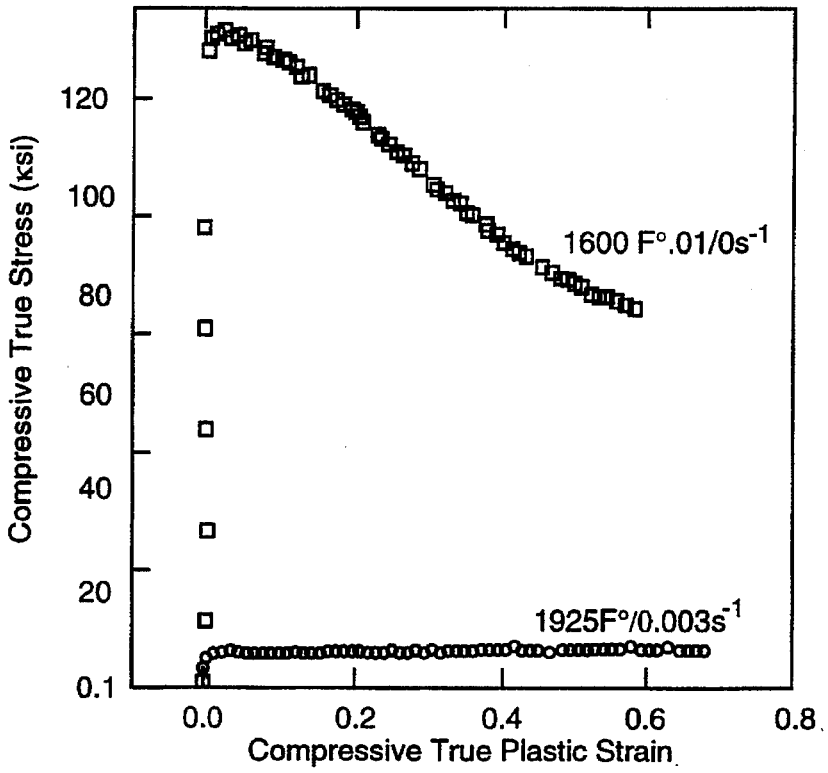
FIG. 5 is a plot of flow stress data as a function of strain rate comparing the die stresses associated with low retained strain and high retained strain forging of Rene' 88DT.
Figure 8A:
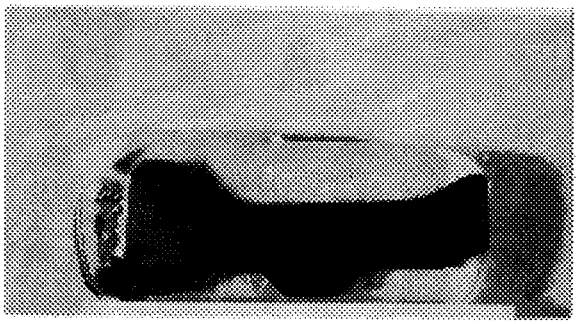
Figure 8B:
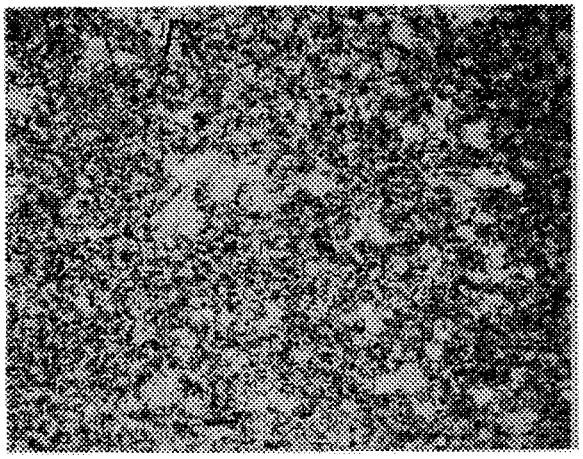

Forging at low temperatures and high strain rates results in high forging loads and die stresses. FIG. 4 is a stress-strain plot for Rene'88DT forged at various temperatures and strain rates. FIG. 5 compares the true stress-true strain curves for the 1600° F./0.1 $s^{-1}$ compression condition to a curve from a compression test run at 1925° F./0.003 $s^{-1}$ (nominal isothermal forging conditions that result in superplastic deformation).

Double Cones

Two conditions were selected from the cylinder matrix: 1600° F./0.1 $s^{-1}$ and 1700° F./0.01 $s^{-1}$ for investigation using the double-cone sample geometry. This test has been shown to be more aggressive in terms of critical grain growth, because it encompasses a greater range of conditions (retained strain) in a single sample compared to a fight circular cylinder. This encourages critical grain growth in certain regions of the samples, depending on processing parameters. For comparison, tests were also run at a condition that was shown to produce critical grain growth in earlier investigations (1925° F. and 0.03 $s^{-1}$). Table 6 contains the results of the double-cone test matrix:

TABLE 5

Grain size after forging and supersolvus heat treatment in double cone specimens

| Temperature | Upset (%) | Strain Rate ($s^{-1}$) | Background Grain Size μm(ASTM) | As large as Grain Size μm(ASTM) |
|---|---|---|---|---|
| 1600° F. | 40 | 0.1 | 13(9) | 70(4.5) |
| 1700° F. | 45 | 0.01 | 13(9) | 133(2.5) |

TABLE 5-continued

Grain size after forging and supersolvus heat treatment in double cone specimens

| Temperature | Upset (%) | Strain Rate ($s^{-1}$) | Background Grain Size μm(ASTM) | As large as Grain Size μm(ASTM) |
|---|---|---|---|---|
| (1925° F.) | 50 | 0.03 | 16(8.5) | 1700(–5) |
| (1925° F.) | 50 | 0.03 | 13(9) | 450(–1) |

Abnormally large grains were observed in the outer region of the sample compressed at 1700° F. and 0.01 $s^{-1}$, whereas the sample compressed at 1600° F. and 0.1 $s^{-1}$ exhibited a uniform grain size throughout the cross section. The 1925° F./0.03 $s^{-1}$ sample contained a bimodal grain size distribution throughout the cross-section. The average grain size was a n average of 13 μm taken near the center, and two measurements of 18 μm taken near the edge. Because of the significant area fraction of large grains, an average large grain size was also measured. ALGS=310 μm.

The upset aim for all tests was 50%. The significant elastic strain resulting from the very high flow stress at the lower temperatures caused the variation in upset observed in this series of tests. It has been observed that lower upsets correlate with CGG. The variation in upset experienced in these tests is not thought to influence the grain structure results.

TEM was performed on the 1925° F./0.03 $s^{-1}$ double cone sample (in the as-compressed condition), and a number of different regions were observed. Some regions contained significant amounts of strain, as indicated by dislocation tangles, and others were essentially dislocation-free. This variation was observed within each foil that was examined. The amount of strain observed was significantly less than that found in the cylinders compressed at lower temperatures.

Subscale Forging Trials

Based on the results of the laboratory compression tests, four forging temperatures and two billet geometries were used to construct an eight run subscale forging matrix. Conditions were chosen to be representative of hot die forging operations.

Billet and die temperatures were significantly lower than those used in isothermal forging operations, and press velocities (strain rates) were significantly higher than those used in isothermal forging. These faster and colder process conditions are well outside the superplastic window (as illustrated by the flow stress curves and microstructures in the laboratory section). Two concerns in this new processing regime were die strength and cracking of the forged article. IN718 dies were operated at 1100° F. to accommodate the high die stresses. No added measures were taken (such as enhanced insulation or canning) to avoid cracking since this was a preliminary assessment of the hot die forging technique to produce the desired grain structure. Additional experiments and most of the modeling work were carried out for a forging temperature of 1700° F. (the temperature that was deemed to be in the middle of the regime of likely success for Rene'88DT (1600° F. to 1800° F.), based on the initial results).

Some of the forgings exhibited cracking in the rim region, as shown. In fact, some of the cracks ran a significant distance into the web. Cracking was more severe at the lower forging temperatures, and it was also postulated that the low die temperatures could be contributing to the cracking. Die temperatures were raised to 1250°–1300° F. for two additional runs with 1700° F. billet temperatures using two spare billets (one of each geometry). There was little or no improvement in cracking.

Simulation of the metal flow during forging was performed for each billet geometry at 1700° F. Metal flow was similar for the two geometries, but local strains and strain rates were quite different, with the 3.5" diameter billet having higher calculated strains and strain rates.

Since adiabatic heating and die chilling occurs during hot die forging, temperature contours were calculated for the 1700° F. forging temperature for both the 3.5" and 4.4" diameter billets. The 3.5" diameter billet also had the highest calculated forging temperature due to the greater adiabatic heating effect.

Polished and etched cross sections were evaluated for uniformness of grain structure after heat treatment. Three heat treatment schedules were applied to sections of each forging:

1) 2100° F./2 hours
2) 1925° F./15 minutes+ramp to 2100° F. in 2 hours+ 2100° F./2 hours
3) 1925° F./8 hours+ramp to 2100° F. in 2 hours+2100° F./2 hours The second procedure is a typical heat treat sequence for production forgings. The third is a procedure that involves an extended subsolvus anneal designed to reduce or eliminate reined strain before ramping to the supersolvus heat treatment temperature. The results of the grain structure evaluations are shown in Table 6.

TABLE 6

Summary of subscale forging results

| S/N | Billet Temp (°F.) | Billet Diameter (inches) | Degree of Crackking | Heat Treatment (hours at 1925° F.) | Critical Grain Growth Rating | Grain Size μm (ASTM) |
|---|---|---|---|---|---|---|
| 7 | 1600 | 3.5 | H | 0 | 0 | 10(10) |
| | | | | 0.25 | 0 | 12(9.5) |
| | | | | 8 | 0 | 13(9) |
| 8 | 1600 | 4.4 | M | 0 | 0 | 9(10) |
| | | | | 0.25 | 0 | 11(9.5) |
| | | | | 8 | 0 | 11(9.5) |
| 3 | 1700 | 3.5 | M | 0 | L | 12(9.5) |
| | | | | 0.25 | 0 | 14(9) |
| | | | | 8 | 0 | 16(8.5) |
| 4 | 1700 | 4.4 | H | 0 | L | 10(10) |
| | | | | 0.25 | 0 | 14(9) |
| | | | | 8 | 0 | 16(8.5) |
| 1 | 1800 | 3.5 | L | 0 | M | 12(9.5) |
| | | | | 0.25 | 0 | 14(9) |
| | | | | 8 | 0 | 18(8) |
| 2 | 1800 | 4.4 | 0 | 0 | L | 10(10) |
| | | | | 0.25 | L | 12(9.5) |
| | | | | 8 | 0 | 11(9.5) |
| 5 | 1900 | 3.5 | L | 0 | H | 13(9) |
| | | | | 0.25 | 0 | 12(9.5) |
| | | | | 8 | 0 | 14(9) |
| 6 | 1900 | 4.4 | L | 0 | M | 12(9.5) |
| | | | | 0.25 | L | 10(10) |
| | | | | 8 | L | 14(9) |
| 9 | 1700 | 3.5 | M | 0 | 0 | 9(10) |
| | | | | 0.25 | 0 | 13(9) |
| | | | | 8 | 0 | 16(8.5) |
| 10 | 1700 | 4.4 | H | 0 | L | 8(10) |
| | | | | 0.25 | 0 | 10(10) |
| | | | | 8 | L | 14(9) |

A high, medium, low, zero (H,M,L,O) relative rating scale was used to compare the amounts of cracking and critical grain growth observed at 1× magnification. For cracking, the number and depth of cracks determined the rating, and for critical grain growth the approximate area fraction of large gains determined the rating. FIGS. 6A and 6B (O cracking), 7A and 7B (L cracking), 8A and 8B (M cracking) and 9A and 9B (H cracking) show examples of cracking associated with each critical grain growth level.

The grain structure was reasonably uniform in the forgings that did not contain critical grain growth. The average grain size varied between 9 and 18 μm (ASTM 8–10). The quantitative readings were taken at a location near the axial and radial midpoint in the forging. Table 7 contains calculated strains, strain rates and temperatures available to describe the thermomechanical history associated with the quantitative measurements. These comparisons can be made only for the 1700° F. and 1900° F. conditions where modeling was performed.

TABLE 7

Local conditions associated with grain size measurements (heat treatment of 1925° F./15 minutes + ramp to 2100° F. in 2 hours + 2100° F./2 hours)

| S/N | Forging condition | Strain | Maximum Strain Rate ($s^{-1}$) | Temp (°F.) | Average Grain Size μm (ASTM) | ALA Grain Size μm (ASTM) |
|---|---|---|---|---|---|---|
| 3 | 1700° F. 3.5" billet | 3.8 | 3 | 1845 | 14(9) | 60(4.7) |
| 4 | 1700° F. 4.4" billet | 3 | 1.5 | 1789 | 14(9) | 60(4.7) |
| 5 | 1900° F. 3.5" billet | 2 | 2 | 1980 | 12(9.5) | 60(4.7) |
| 6 | 1900° F. 4.4" billet | 1.5 | 2 | 1955 | 10(10) | 40(6) |

It is not surprising that the grain sizes are similar, since the calculated strain and strain rate values are within approximately a factor of two of each other. The calculated temperatures are grouped within a range of 200° F. The ALA measurements are only for the fields of view near the axial and radial midpoint of the forging. A patch of critical grain growth at the surface of the rib feature in S/N 6 was not included in the ALA number in Table 7.

Figure 11:
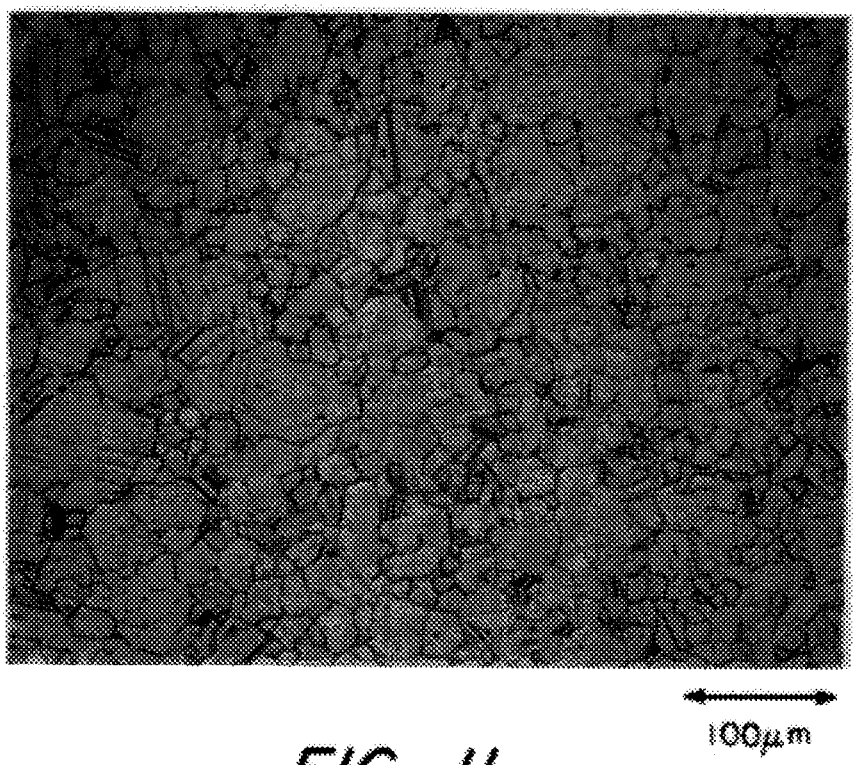
FIG. 11 is an optical photomicrograph of the microstructure near the axial and radial midpoint of the forging of FIG. 13.
Figure 10:
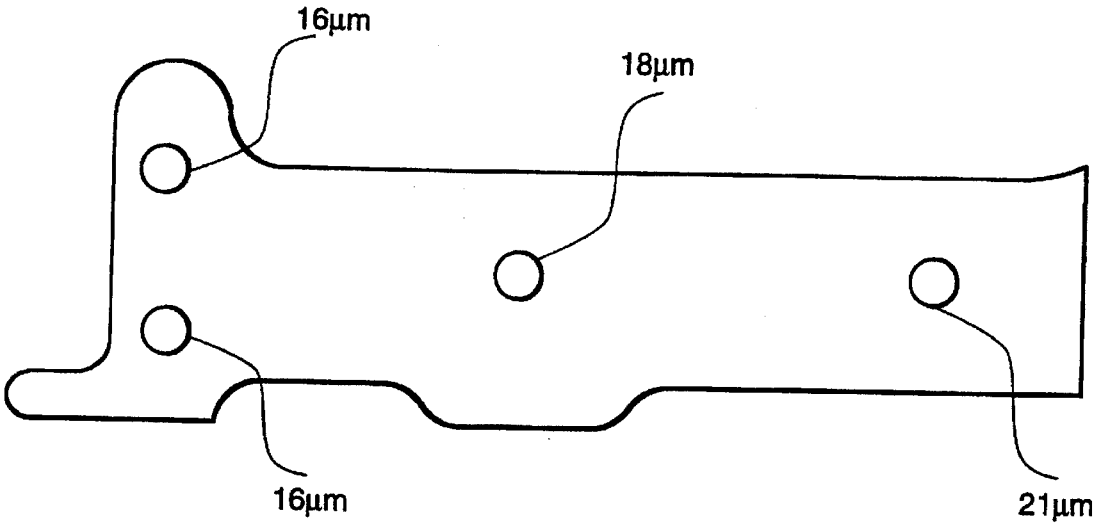
FIG. 10 schematically shows grain size as a function of location in subscale forging S/N 3, a 1700° F. —3.5 inch billet after an extended subsolvus anneal followed by production heat treatment.

To investigate the uniformity of the grain structure within a forging, grain size was measured at the locations shown in FIG. 10 (1700° F.–3.5" billet—extended subsolvus anneal followed by production heat treatment). The grain size results are also included in this figure, along with FIG. 11 which is a photomicrograph of the microstructure from near the axial and radial midpoint of the forging. The grain size results showed a reasonably good correlation with the modeling results (e.g. areas within the forging that experienced similar strains and strain rates had similar grain sizes after annealing).

The results tabulated in Table 4 were entered into a commercially available computer program for statistical analysis known as SAS to evaluate the trends in a quantitative manner. For the relative ratings, values of 0,3,6 and 9 were assigned for ratings of O, L, M and H respectively. The following variables were evaluated for their effects on cracking, CGG and resultant grain size: forging temperature, billet diameter (upset), and time at 1925° F. during heat treatment. There was insufficient data on die temperature for meaningful comparison. The results of the analysis are shown in Table 8.

TABLE 8

Correlation of response variables to the input conditions (according to SAS ™ (with 95% confidence)

| RESPONSE | INPUT |
|---|---|
| amount of CGG decreases with | reduction in forging temperature |
| amount of CGG decreases with | increase in time at 1925° F. |
| amount of cracking decreases with | increase in forging temperature |
| grain size decreases with | increase in starting billet diameter |
| grain size decreases with | reduction in time at 1925° F. |

While most of these results agree well with what it presently known about the forging of γ' Ni-base superalloys, one significant and unexpected result was that increasing the time at 1925° F. before the supersolvus heat treatment was universally better for reducing the propensity for CGG and improving the uniformity of the grain structure.

The stated strategy for avoiding critical grain growth in this demonstration was to introduce sufficient dislocation density to avoid nucleation limited recrystallization and grain growth. Applicants have observed that longer times at 1925° F. reduced the dislocation density. These studies were performed on specimens compressed using conditions similar to those for isothermal forging. These studies did not determine whether recovery or recrystallization was responsible for the reduction in strain energy. TEM results presented in this study on double cones compressed at 1600° F. and 0.1 $s^{-1}$ suggest that annealing at 1925° F. causes recrystallization in this heavily deformed microstructure.

Figure 12:
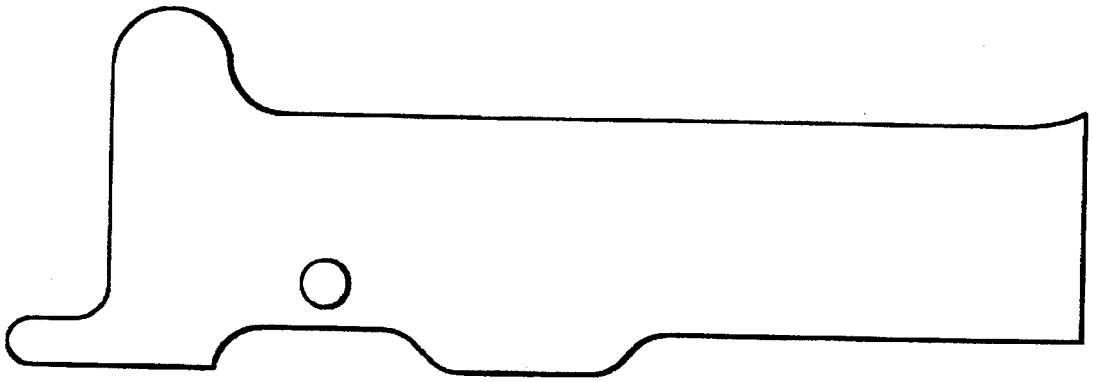
FIG. 12 is an illustration indicating the location from which TEM foils of FIGS. 17A and 17B were taken. This location was consistent with the band of large grains observed after direct 2100° F. heat treatment of S/N 5.

A focused TEM investigation was performed on subscale forgings S/N 7 (3.5" billet, 1600° F.) and S/N 5 (3.5" billet, 1900° F.). For each of these forgings, samples were taken from identical locations (see FIG. 12). Foils were examined from the as-compressed and extended subsolvus annealed conditions (1925° F./8 hours).

Figure 13:
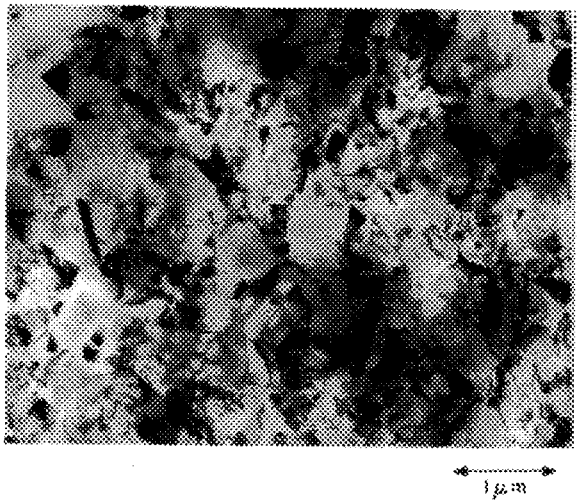
FIGS. 13 and 14 are TEM photomicrographs of the microstructure of forgings after compression at 1600° F. (S/N 7) and 1900° F. (S/N 5), respectively
Figure 14:
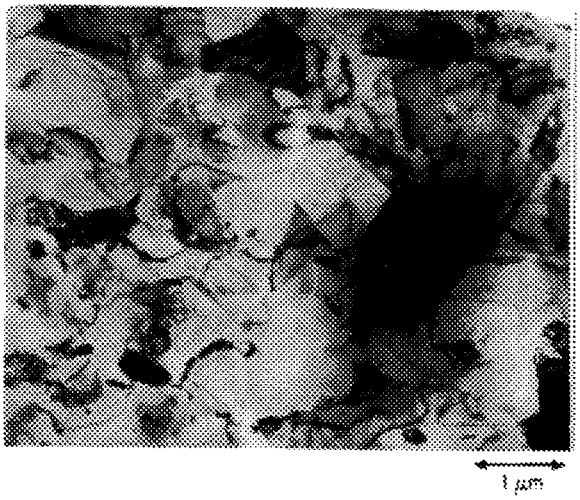

FIGS. 13 and 14 illustrate a subtle difference in the as-compressed microstructures for each forging. Significant recrystallization appears to have taken place during forging (dynamic), or during the cool down after forging (metadynamic). Some regions remain unrecrystallized, and these regions appear to constitute ~10% of the volume in each region that was analyzed. The recrystallized grain size of S/N 7 is ,~0.5 μm, and the recrystallized grain size of S/N 5 is ~1 μm. Care must be taken in interpreting these results, as the extrusion (before compression) exhibits a 3–5 μm grain size and a similar unrecrystallized volume.

The location where the TEM foil was taken was consistent with the large grain band that formed in S/N 5 after direct 2100° F. heat treatment. The microstructure of S/N 5 did not exhibit any features or provide any indication that supersolvus heat treatment should cause CGG. The recrystallized grain size was slightly larger than S/N 7, and the amount of retained strain in the unrecrystallized regions was slightly less than that of S/N 7 (from SAD patterns and TEM images). MC, boride, and oxide particles were observed in both microstructures, and their distributions were similar to other Rene'88 microstructures. The subtle differences could be important, but it is difficult to formulate a consistent rationale for why the large grains appear in S/N 5 after direct supersolvus heat treatment, and they are absent from S/N 7.

Figure 15:
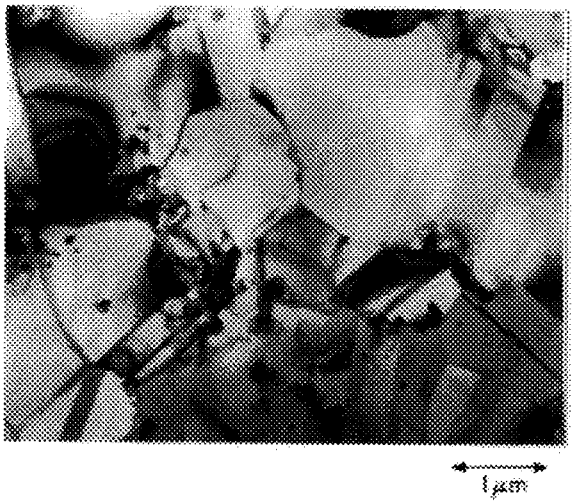
FIGS. 15 and 16 are TEM photomicrographs of the microstructure of forgings after compression at 1600° F. (S/N 7) and 1900° F. (S/N 5), respectively, after a subsolvus anneal of 1925° F. for 8 hours.
Figure 16:
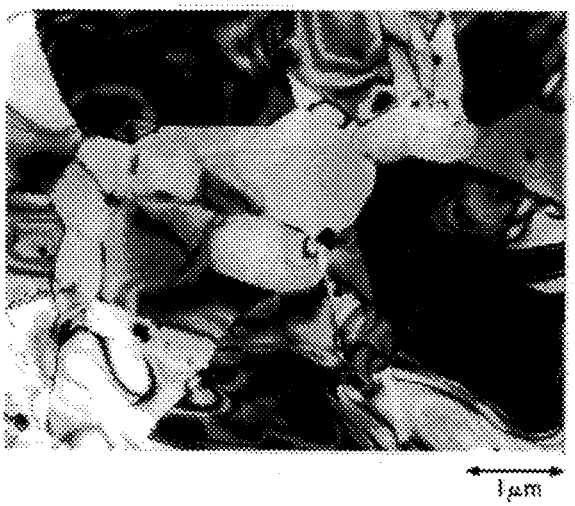
Figure 17:
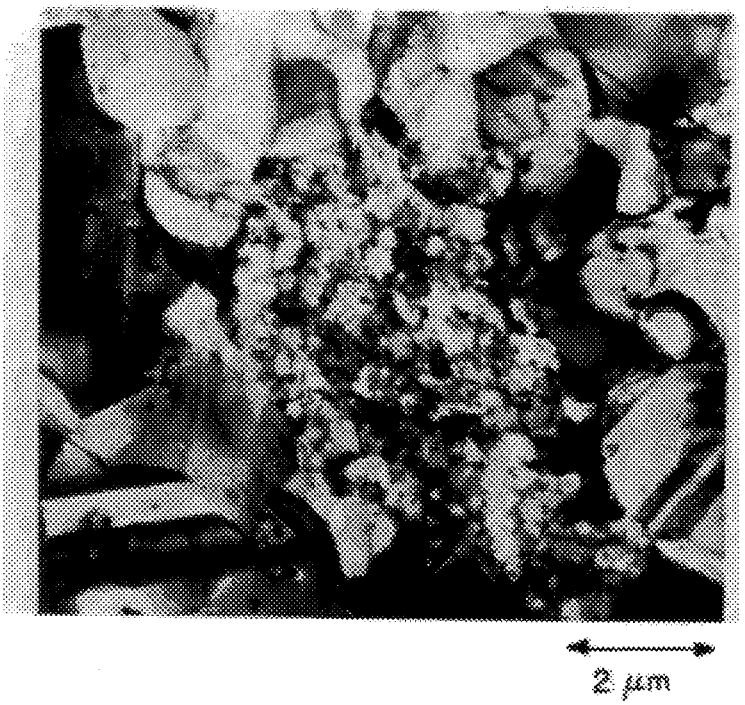
FIG. 17 is a TEM photomicrograph of the microstructure of S/N5 showing an unrecrystallized region observed in the 1900° F. forging, after subsolvus anneal (1925° F. / 8 hours)

The microstructures of the forgings after receiving an extended subsolvus anneal are shown in FIGS. 15 and 16. There was a significant reduction in the amount of strain retained in the microstructures. The grain sizes were recorded as 3–5 μm. The microstructures are essentially fully recrystallized, and low angle boundaries were observed in both samples. A single unrecrystallized region was located in S/N 5 (see FIG. 17).

The TEM results for microstructures given an extended subsolvus anneal indicate that recrystallization was nearly complete before the ramp to 2100° F. was initiated. This heat treatment approach represents a modification to the stated strategy. This approach relies on the forging operation to produce enough retained strain to allow complete recrystallization below the γ' solvus and ensure that the microstructure is strain-free prior to heat treatment above the γ' solvus.

The results of the subscale hot die forging experiments summarized in Table 4 and Table 6 coupled with the TEM results on double cone and contoured subscale forgings indicate that two strategies are available for avoiding critical grain growth. One is to ensure that there is no retained strain in the microstructure before crossing the γ' solvus. A second is to ensure that there is sufficient strain to promote a high nucleation density of recrystallization during the supersolvus heat treatment, as described for example in U.S. Pat. No. 5,413,572.

Furthermore, there are at least two practical production methods for carrying out the first strategy. For example, current isothermal forging practices are aimed at using superplastic deformation to achieve the shape change without causing an increase in dislocation density. Therefore, subsequent supersolvus heat treatment may be given to a microstructure that is essentially free from retained strain. However, in practice, variability in the process may result in local areas being forged outside the superplastic window, which results in retained strain. A second approach (the subject of this invention) involves using lower forging temperatures and faster strain rates, typical of hot die forging practices. This practice introduces a high dislocation density into the microstructure of the forged article. The next step is to anneal the component for an extended period at a temperature that is below the γ' solvus, so as to achieve complete recrystallization, particularly prior to supersolvus heat treatment.

The second strategy also presents an opportunity to apply the hot die forging technique to avoid CGG. This process does not appear to be as robust a process as the extended subsolvus anneal approach. The data generated in this study indicate that the forging temperature must be below ~1700° F. to avoid CGG for a press velocity around 30 in/min. This temperature range coincides with the temperature range that cracking was observed. Further process development or canning would be required for successful application of this method.

Reverting to hot die forging combined with an extended subsolvus anneal would represent significant cost saving and productivity improvements for advanced gas turbine rotor component fabrication. A potential processing route that addresses concerns about simultaneously avoiding CGG and eliminating cracking involves two-step forging. The first step of the process involves isothermally forging the billet in the superplastic range to an intermediate shape. The second and final step is a hot die forging upset that ensures all pans of the forging contain sufficient retained metallurgical strain to promote subsequent recrystallization. This should lead to a uniform, fine gain microstructure after the extended subsolvus or extended subsolvus/supersolvus heat treatment.

The grain size typical of isothermal forging and supersolvus heat treatment of Rene'88DT is ASTM 6–8. As noted earlier, hot die forging, with an extended subsolvus anneal produces a grain size of ASTM 10–12, and an additional relatively short supersolvus anneal, produces a grain size range of about ASTM 8–10, thereby defining a range of grain sizes of ASTM 8–12. More extended subsolvus or supersolvus anneals are expected to produce lager grain sizes of at least ASTM 5, or larger, thereby defining a range of ASTM 5–12. This was a significant and unexpected result, particularly when compared to the grain size results that have been obtained using either isothermal forging or hot die forging and a supersolvus anneal. The uniform, finer grain, supersolvus heat treated microstructure that is produced by colder, faster forging of these superalloys may be useful for a number of applications where strength and LCF performance are key design criteria. Specifically the finer grain size and ability to obtain complete solution of primary $\gamma'$ provide potential for a higher strength microstructure compared to either conventionally processed or non-supersolvus heat treated superalloys. Thus hot die forging can produce desirable grain structures. Hot die forging in the range of 1600° F. –1700° F. eliminated CGG with the standard production supersolvus heat treatment. However, die fill and cracking were a problem. Hot die forging at higher temperatures eliminated CGG when combined with an extended subsolvus anneal (1925° F./8 hrs) prior to the supersolvus heat treatment step. Die fill and cracking response was also improved under these conditions.

The foregoing embodiments have been disclosed for the purpose of illustration of the present invention, and are not intended to be exhaustive of the potential variations thereof. Variations and modifications of the disclosed embodiments will be readily apparent those skilled in the art. All such variations and modifications are intended to be encompassed by the claims set forth hereinafter.

What is claimed is:

1. A method of making an article having a controlled grain size from a Ni-base superalloy, comprising the steps of:

providing a Ni-base superalloy having a recrystallization temperature, a $\gamma'$ solvus temperature and a microstructure comprising a mixture of $\gamma$ and $\gamma'$ phases, wherein the $\gamma'$ phase occupies at least 30% by volume of the Ni-base superalloy;

working the superalloy at preselected working conditions, comprising a working temperature less than the $\gamma'$ solvus temperature and a strain rate greater than a predetermined strain rate, $\dot{\epsilon}_{min}$ sufficiently to store a predetermined minimum amount of retained strain, $\epsilon_{min}$, per unit of volume throughout the superalloy, to form an article, wherein $\epsilon_{min}$ is sufficient to promote subsequent recrystallization of a uniform grain size microstructure throughout the article;

subsolvus annealing the article at a subsolvus temperature for a time sufficient to cause recrystallization of a uniform grain size throughout the article; and cooling the article from the subsolvus annealing temperature at a predetermined rate in order to cause the precipitation of $\gamma'$.

2. The method of claim 1, wherein the superalloy comprises an extruded billet formed by hot-extruding a pre-alloyed powder comprising the Ni-base superalloy.

3. The method of claim 1, wherein the superalloy has a composition of 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent, excepting incidental impurities.

4. The method of claim 1, wherein the $\dot{\epsilon}_{min}$ is 0.01 $s^{-1}$.

5. The method of claim 1, wherein the $\epsilon_{min}$ corresponds to the amount of strain energy developed in the superalloy by 6 percent strain at room temperature.

6. The method of claim 1, wherein the working temperature is ≦600° F. below the solvus temperature.

7. The method of claim 1, wherein the subsolvus annealing temperature is ≦100° F. below the solvus temperature and the subsolvus annealing time is between about 4–168 hours.

8. The method of claim 1, wherein the article has a uniform grain size after recrystallization of about 10 μm or smaller.

9. The method of claim 1, wherein the step of cooling is done at a rate in the range of about 100°–600° F./minute.

10. A method of making an article having a controlled grain size from a Ni-base superalloy, comprising the steps of:

providing a Ni-base superalloy having a recrystallization temperature, a $\gamma'$ solvus temperature and a microstructure comprising a mixture of $\gamma$ and $\gamma'$ phases, wherein the $\gamma'$ phase occupies at least 30% by volume of the Ni-base superalloy;

working the superalloy at preselected working conditions, comprising a working temperature less than the $\gamma'$ solvus temperature and a strain rate greater than a predetermined strain rate, $\dot{\epsilon}_{min}$ sufficiently to store a minimum amount of retained strain, $\epsilon_{min}$, per unit of volume throughout the superalloy, to form an article, wherein $\epsilon_{min}$ is sufficient to promote subsequent recrystallization of a uniform grain size microstructure throughout the article;

subsolvus annealing the article at a subsolvus temperature for a time sufficient to cause recrystallization of a uniform grain size throughout the article; and supersolvus annealing the article at a supersolvus temperature for a time sufficient to cause the dissolution of at least a portion of the $\gamma'$ and the coarsening of the recrystallized grain size to a larger solutionized grain size;

cooling the article from the subsolvus annealing temperature at a predetermined rate in order to cause the precipitation of $\gamma'$.

11. The method of claim 10, wherein the superalloy comprises an extruded billet formed by hot-extruding a pre-alloyed powder comprising the Ni-base superalloy.

12. The method of claim 10, wherein the superalloy has a composition of 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent, excepting incidental impurities.

13. The method of claim 10, wherein the $\dot{\epsilon}_{min}$ is 0.01 $s^{-1}$.

14. The method of claim 10, wherein the $\epsilon_{min}$ corresponds to the amount of strain energy developed in the superalloy by 6 percent swain at room temperature.

15. The method of claim 10, wherein the working temperature is ≦600° F. below the solvus temperature.

16. The method of claim 10, wherein the subsolvus annealing temperature is ≦100° F. below the solvus temperature and the subsolvus annealing time is between about 4–168 hours.

17. The method of claim 10, wherein the supersolvus annealing temperature is ≦100° F. above the solvus temperature and the supersolvus annealing time is between about 0.25–5 hours.

18. The method of claim 10, wherein the article has an average solutionized grain size after supersolvus annealing of about 10–60 μm.

19. The method of claim 1, wherein the step of cooling is done at a rate in the range of about 100°–600° F./minute.

20. The method of claim 10, further comprising the step of aging the article at a temperature and for a time sufficient to provide a stabilized microstructure in the article that is useful for operation at elevated temperatures up to 1400° F.

* * * * *